US006729790B1

(12) United States Patent
Moor et al.

(10) Patent No.: US 6,729,790 B1
(45) Date of Patent: May 4, 2004

(54) DIVIDER POCKET

(75) Inventors: Marc L. Moor, Oakwood, OH (US); Jeffrey T. DeBord, Worthington, OH (US); Diana W. Juratovac, Columbus, OH (US); Steven L. Paletti, Worthington, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 09/711,768

(22) Filed: Nov. 13, 2000

(51) Int. Cl.[7] ..... B42F 13/00

(52) U.S. Cl. ..... 402/75; 281/38; 283/36; 402/73; 402/80 R; D19/32

(58) Field of Search ..... 281/2, 5, 12, 38; 283/36, 61, 62; 402/70, 73, 75, 79, 80 R; D19/32, 33

(56) References Cited

U.S. PATENT DOCUMENTS

| | | | | | |
|---|---|---|---|---|---|
| 717,957 | A | | 1/1903 | Weaver | |
| 792,747 | A | | 6/1905 | Anderson et al. | |
| 852,871 | A | | 5/1907 | Cohn | |
| 868,758 | A | | 10/1907 | Bexell | |
| 1,107,351 | A | | 8/1914 | Proudfit | |
| 1,156,160 | A | | 10/1915 | Lewis | |
| 1,371,459 | A | | 3/1921 | Amlie | |
| 2,153,575 | A | | 4/1939 | Kramer | |
| 2,677,376 | A | | 5/1954 | Brunner | 129/1 |
| 2,848,163 | A | | 5/1958 | Van Horne Serrell | |
| 4,296,945 | A | | 10/1981 | Pavlik | 281/1 |
| 4,430,015 | A | * | 2/1984 | Nerlinger | 402/79 |
| 4,551,039 | A | | 11/1985 | Basseches | |
| 4,636,179 | A | | 1/1987 | Gentile et al. | |
| 4,802,575 | A | | 2/1989 | Martin | 206/232 |
| 4,838,724 | A | | 6/1989 | Spence, Jr. | 402/79 |
| 4,940,353 | A | | 7/1990 | Osono et al. | |
| 4,961,596 | A | | 10/1990 | Moor | 281/15.1 |
| 5,015,114 | A | | 5/1991 | Miller | |
| 5,036,973 | A | | 8/1991 | Aida | 206/214 |
| 5,066,046 | A | * | 11/1991 | Hoopingarner | 283/70 |
| 5,234,277 | A | | 8/1993 | Le | |
| 5,294,208 | A | | 3/1994 | Tremmel, Jr. et al. | 402/70 |
| 5,405,169 | A | | 4/1995 | Schwartz | |
| 5,433,546 | A | | 7/1995 | Kershaw | |
| 5,476,336 | A | * | 12/1995 | Osiecki et al. | 402/79 |
| 5,489,120 | A | * | 2/1996 | Thornsburg | 281/33 |
| 5,572,815 | A | | 11/1996 | Kovner | |
| 5,597,256 | A | * | 1/1997 | Burton et al. | 402/4 |
| 5,709,496 | A | * | 1/1998 | Werner et al. | 402/79 |
| 5,727,894 | A | | 3/1998 | Covey | |
| 5,806,677 | A | * | 9/1998 | Storti | 206/425 |
| 5,876,144 | A | | 3/1999 | Bedol et al. | 402/4 |
| D408,860 | S | | 4/1999 | Ho | D19/90 |
| 5,909,979 | A | * | 6/1999 | Winzen | 402/79 |
| 5,911,441 | A | | 6/1999 | Yamamoto et al. | 281/15.1 |
| 5,951,190 | A | | 9/1999 | Wilson | 402/73 |
| 6,017,062 | A | | 1/2000 | White | 281/29 |
| 6,059,478 | A | * | 5/2000 | Moor | 402/73 |
| 6,082,612 | A | * | 7/2000 | Black | 229/67.1 |
| 6,086,281 | A | * | 7/2000 | Covey | 402/79 |
| 6,135,662 | A | * | 10/2000 | Bakke et al. | 402/73 |
| 6,193,065 | B1 | * | 2/2001 | Salomone | 206/455 |
| 6,209,778 | B1 | * | 4/2001 | Henrikson et al. | 229/67.1 |
| 6,249,390 | B1 | * | 6/2001 | Thibodeaux, Jr. | 359/802 |
| 6,431,779 | B1 | * | 8/2002 | Moor et al. | 402/73 |

* cited by examiner

*Primary Examiner*—Monica S. Carter
(74) *Attorney, Agent, or Firm*—Thompson Hine LLP

(57) ABSTRACT

A divider for use in a binder having a binding mechanism, the divider including a generally rigid inner portion shaped to be coupled to the binding mechanism. The divider further includes a pocket outer portion, the outer portion being coupled to the inner portion and including an inner cavity for storing loose items.

34 Claims, 4 Drawing Sheets

DIVIDER POCKET

The present invention is directed to a divider for use with a binder, and more particularly, to a divider for use with a binder, the divider having a pocket thereon.

BACKGROUND OF THE INVENTION

Binders are widely used by students, professionals and other users for storing loose leaf papers, handouts, school and business supplies, and the like. Such binders typically include a spine, a pair of outer covers and a binding mechanism for receiving loose leaf papers. The binders may also include one or more dividers coupled to the binding mechanism to separate and identify various sections of papers within the binder.

School and business supplies, such as pens, pencils, calculators, cell phones, etc., are often used in conjunction with a binder. However, a traditional binder and most existing dividers do not provide a storage space for such supplies. Accordingly, there is a need for a divider that has a storage space for receiving loose items.

SUMMARY OF THE INVENTION

The present invention is a divider which includes a pocket mounted thereon, the pocket being located at an outer edge of the divider to receive loose items. In a preferred embodiment, the invention is a divider for use in a binder having a binding mechanism, the divider including a generally rigid inner portion shaped to be coupled to the binding mechanism. The divider further includes a pocket outer portion, the outer portion being coupled to the inner portion and including an inner cavity for storing loose items.

Other objects and advantages of the present invention will be apparent from the following description and the accompanying drawings.

DETAILED DESCRIPTION

Figure 1:
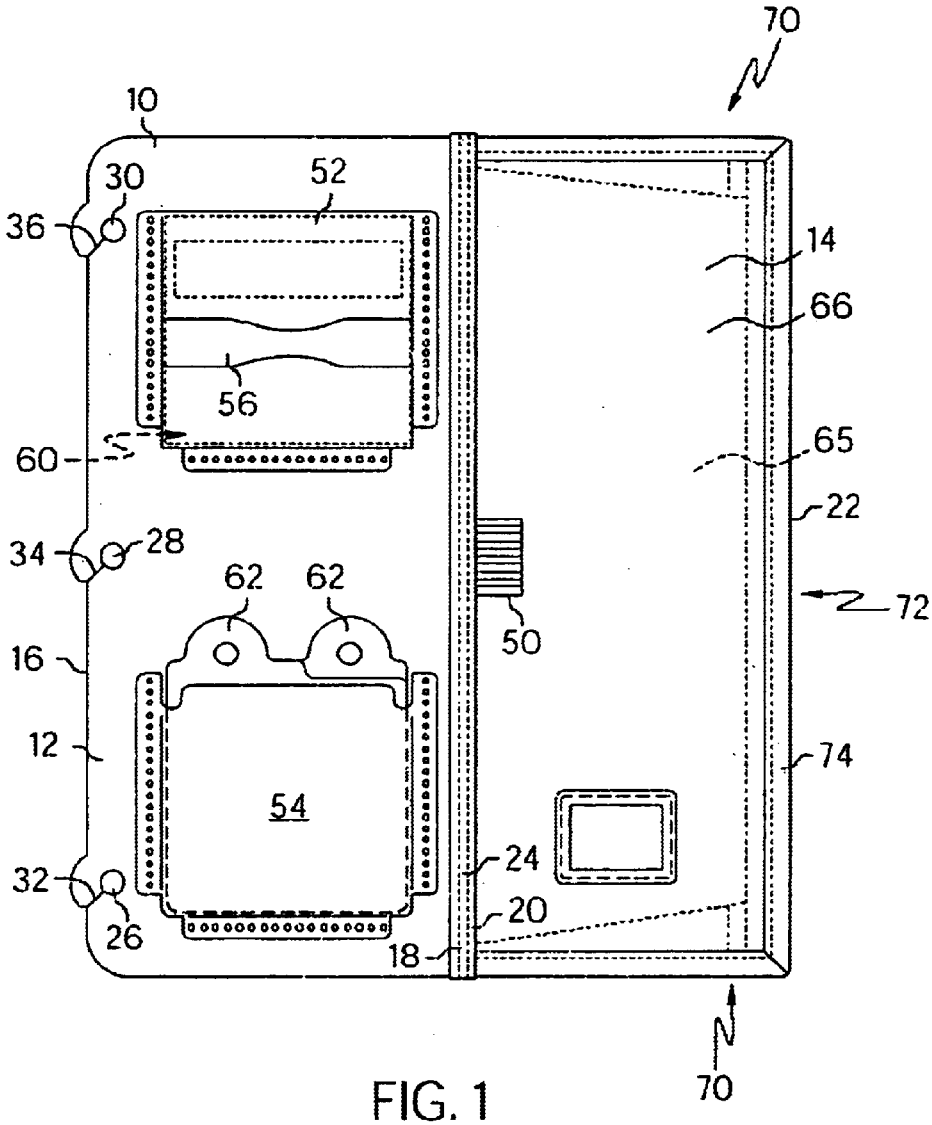
FIG. 1 is a front view of one embodiment of the divider pocket of the present invention.

As best shown in FIG. 1, the divider pocket 10 of the present invention includes a generally rigid inner portion 12 and a pocket outer portion 14 coupled to, and generally co-planar with, the inner portion. The inner portion 12 has an inner edge 16 and an outer edge 18, and the pocket portion 14 similarly includes an inner edge 20 and an outer edge 22. The inner edge 20 of the pocket portion 14 is attached to the outer edge 18 of the inner portion 12, preferably by a layer of stitched material 24. The inner portion 12 is preferably made of relatively rigid, translucent materials, but preferably retains some flexibility. The inner portion 12 preferably has a thickness such that the divider pocket 10 can easily be located by sense of touch when rifling through a notebook including the divider pocket. However, the inner portion 12 preferably retains sufficient flexibility to be bent or deformed. In one embodiment, the inner portion 12 is made of 0.85 mm thick polypropylene.

Figure 4:
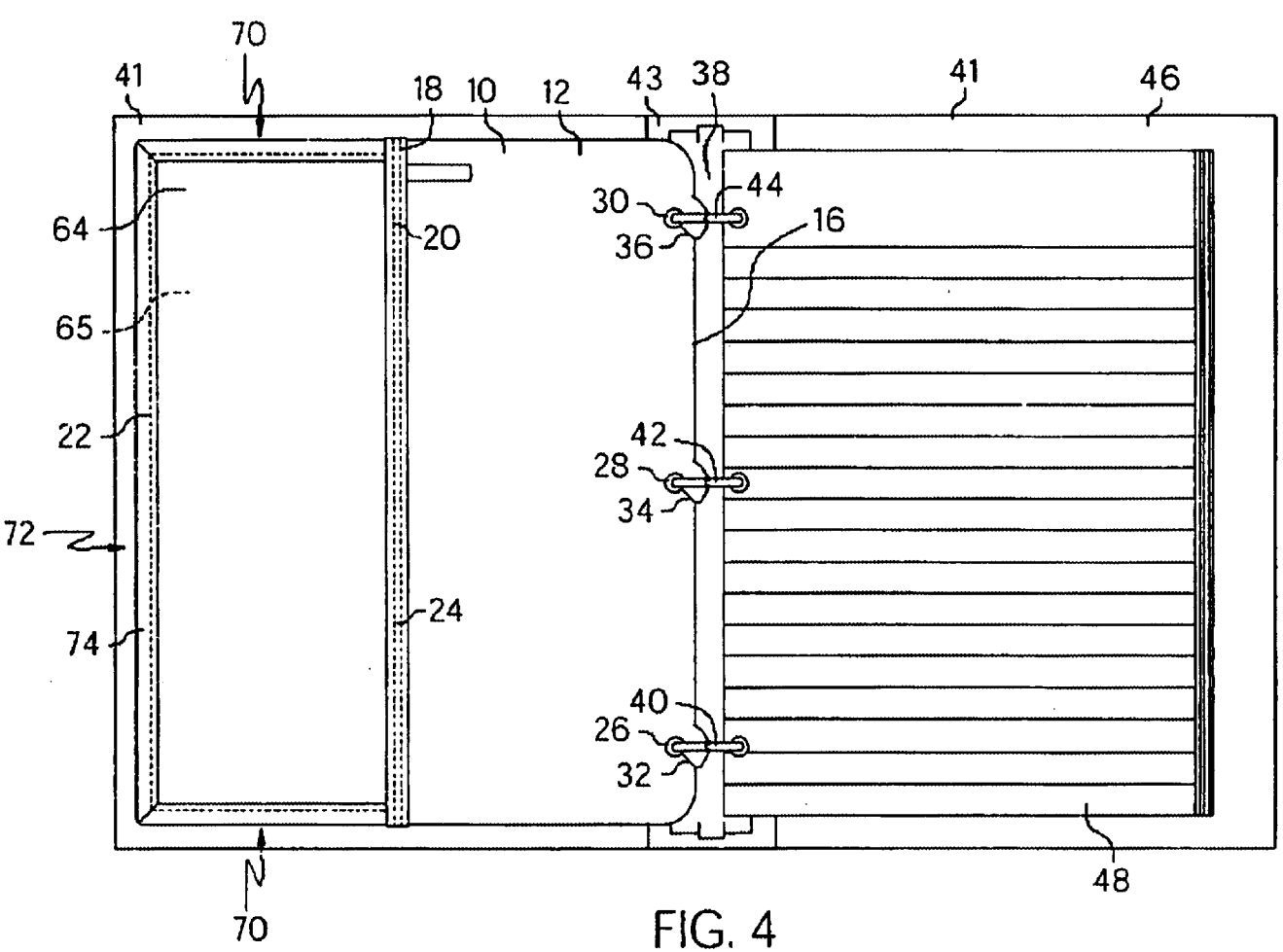
FIG. 4 is a bottom view of the divider pocket of FIG. 1, shown coupled to a binder.
Figure 3:
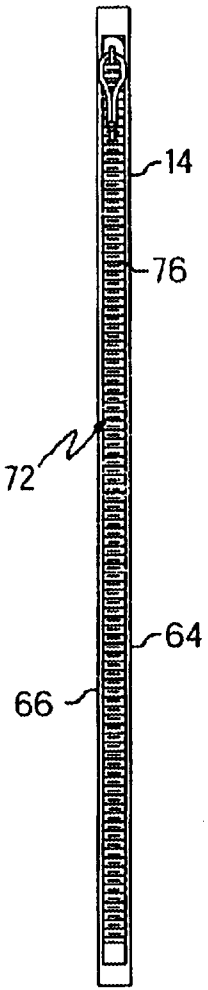
FIG. 3 is an end view of the divider pocket of FIG. 1.

In the illustrated embodiment, the inner portion 12 includes a set of three openings 26, 28, 30 formed along its inner edge 16, and each hole 26, 28, 30 includes a slit 32, 34, 36 extending from the inner edge 16 to the associated opening. As shown in FIG. 4, the openings 26, 28, 30 are shaped and located to receive a binding mechanism, such as a three-ring binding mechanism 38 of binder 46 therethrough to couple the divider pocket 10 to the binding mechanism 38. The slits 32, 34, 36 of the inner portion 12 enable the divider pocket 10 to be coupled to the binding mechanism 38 by sliding each slit 32, 34, 36 over an associated ring 40, 42, 44 of the binding mechanism 38. The slits 32, 34, 36 thus provide a "quick-attach" feature that enables the divider pocket 10 to be coupled to a three-ring binder 46 without opening the binding rings 40, 42, 44. Of course, the shape and location of the holes 26, 28, 30 may be varied to accommodate various shapes and configurations of binding mechanisms; however, in a preferred embodiment the divider pocket 10 includes at least two holes formed therein.

As shown in FIG. 4, the inner edges 16, 20 and outer edges 18, 22 extend generally parallel to the binding mechanism 38 when the inner portion 12 is attached to the binding mechanism 38. The binder 46 includes a pair of outer covers 41 and a spine 43. The binder 40 can receive a plurality of papers 48 or other items, and the divider pocket 10 is preferably approximately about the same size in top view as the papers 48 (i.e. in one embodiment 8.5"×11") such that the divider 10 fits neatly into the binder 40, but is easily locatable to act as a divider for different sections within the binder 46. The illustrated divider pocket 10 also includes a pencil loop 50 (FIG. 1) located over the outer pocket portion 14 adjacent to its inner edge 20.

The inner portion 12 may include an upper retaining pocket 52 and a lower retaining pocket 54 located thereon. The retaining pockets 52, 54 are preferably made from relatively thin sheets of transparent, flexible material coupled to the inner portion 12, such as by ultrasonic welding. The upper retaining pocket 52 includes a central slit 56 formed therein which enables the pocket 52 to receive a stack of papers therein. The upper retaining pocket 52 is particularly adapted to receive a stack of accordion-style adhesive-backed note sheets 60, such as POST-IT® adhesive backed papers. The central slit 56 of the upper retaining pocket 52 enables the retaining pocket 52 to act as a dispenser of the accordion-style adhesive note sheets 60. The lower retaining pocket 54 can be used to receive various notes, identifying sheets, reference cards 62 and the like.

Figure 2:
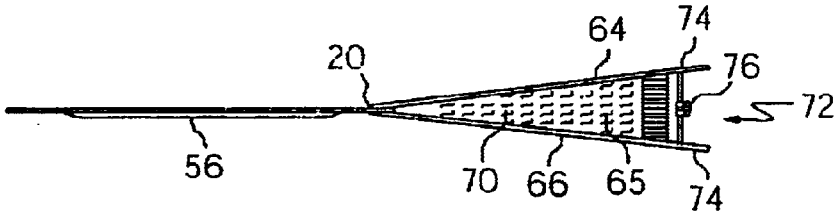
FIG. 2 is a side view of the divider pocket of FIG. 1.

The outer pocket portion 14 includes a pouch or inner cavity 65, and is preferably attached to the inner portion 12 by stitching material 24. In one embodiment, the outer pocket portion 14 includes flexible, transparent upper 66 and lower 64 panels (FIG. 2) directly attached to each other adjacent to the inner edge 20 of the pocket portion 14. In one embodiment, the panels 64, 66 are formed of a 0.35 mm thick clear PVC which enables the user to view the contents of the pocket portion. The pocket portion 14 further preferably includes a pair of generally triangular-shaped end gussets 70, which enables the pouch 65 to expand as needed. The pocket portion 14 includes an access opening 72 located between the outer edges 74 of the panels 64, 66 that is selectively openable and closable by a fastener 76. Of course, various fasteners 76 such as zippers, zip-locks, hook-and-loop fasteners, snaps, clasps and the like may be used without departing from the scope of the present invention.

Figure 5:
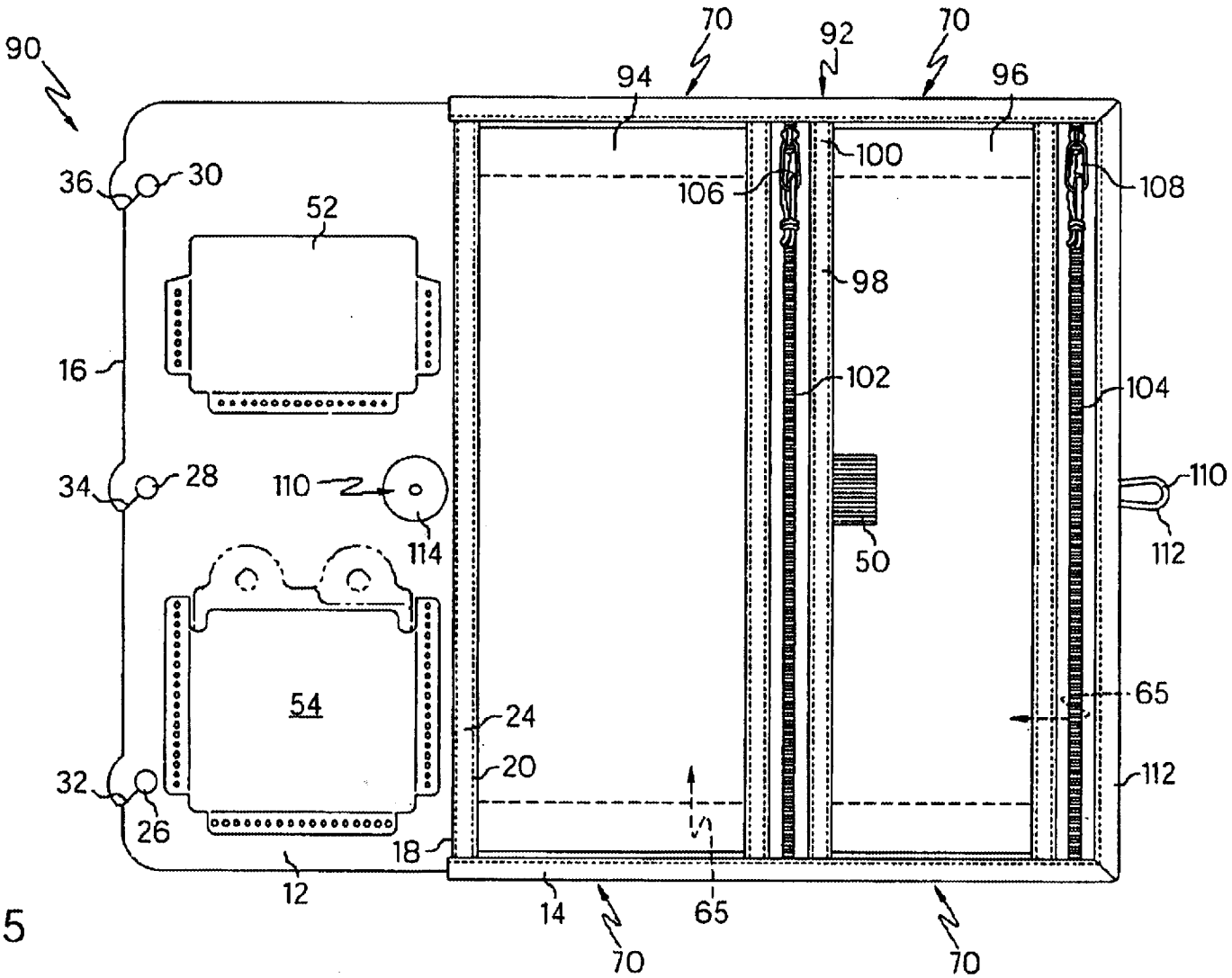
FIG. 5 is a front view of an alternate embodiment of the divider pocket of the present invention, shown in its unfolded condition.
Figure 6:
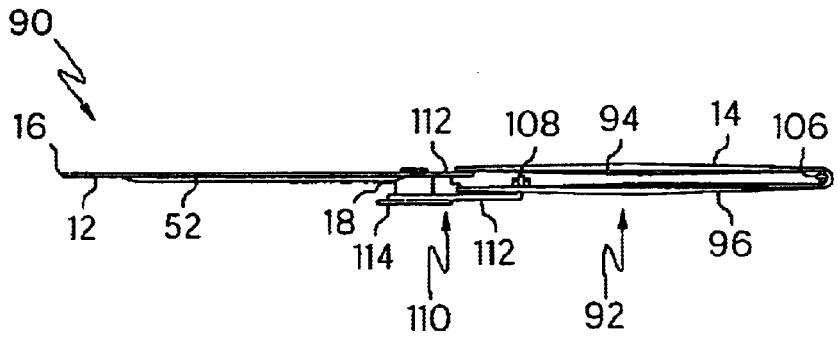
FIG. 6 is a side view of the divider pocket of FIG. 5, shown in its folded condition.
Figure 7:
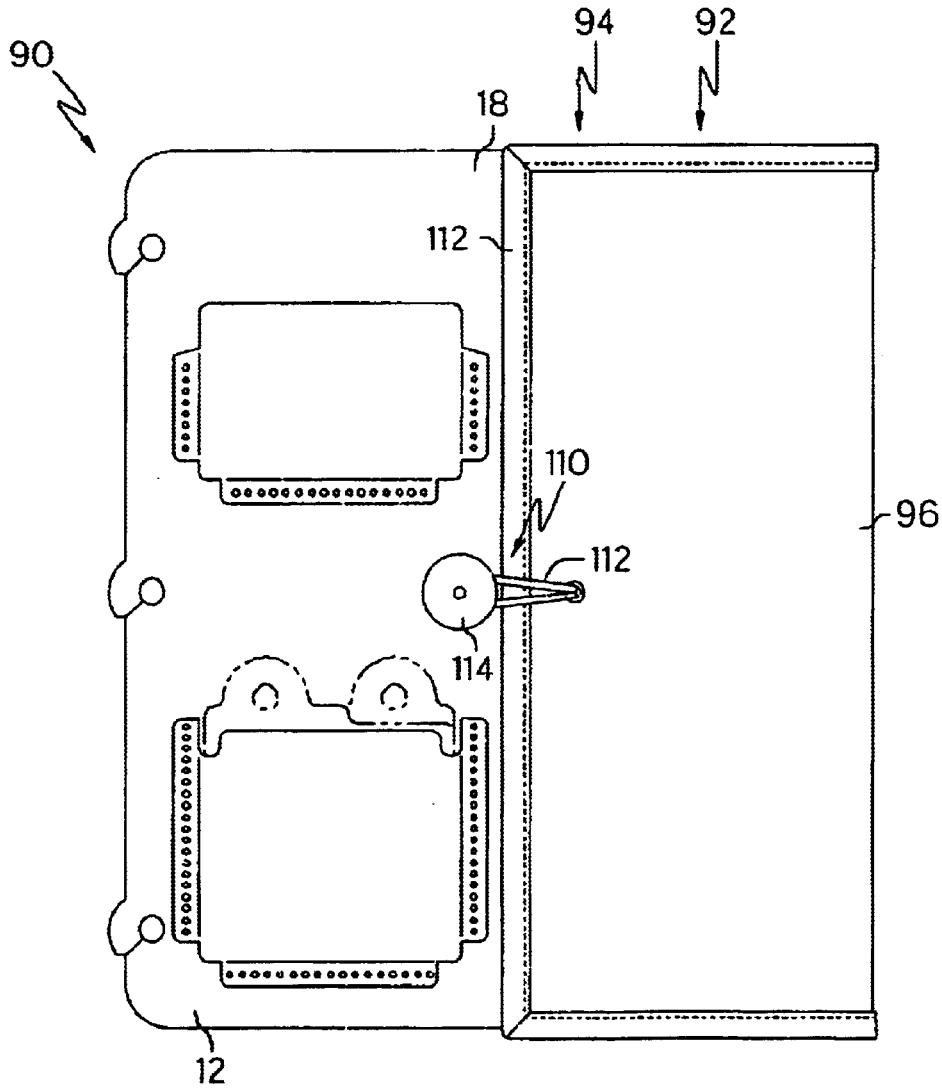
FIG. 7 is a front view of the divider pocket of FIG. 5, shown in its folded condition.

FIGS. 5–7 illustrate an alternate divider pocket 90 of the present invention, wherein the outer pocket portion 92 includes a first pocket portion 94 and a second pocket portion 96 located adjacent to the first pocket portion 92. The first pocket portion 94 is essentially identical to the outer pocket portion 14 of the embodiment of FIGS. 1–4, and the second pocket portion 96 provides an auxiliary storage space. The inner edge 98 of the second pocket portion 96 is coupled to the outer edge 100 of the first pocket portion 94. Both the first 94 and second 96 pocket portions include access openings 102, 104, respectively, that are closable by a zipper or other closing mechanism 106, 108.

As shown in FIGS. 6–7, the second pocket portion 96 is foldable over the first pocket portion 94. The divider pocket 90 further includes a retaining mechanism, generally designated 110, for maintaining the second pocket 96 portion folded over the first pocket portion 94. In the illustrated embodiment, the retaining mechanism 110 includes a loop of preferably elastic material 112 located at the underside of the outer edge of the second pocket portion 96, and a grommet 114 located adjacent the outer edge 18 of the inner portion 12. When the outer pocket portion 96 is in its closed position (i.e., folded over the inner pocket portion 94), the loop 112 can be stretched and fit around the grommet 114 to retain the second pocket portion 96 in its folded position (FIGS. 6–7). Of course, the location of the grommet 114 and the loop 112 may be reversed such that the loop 112 is located on the rigid inner portion 12 and the grommet 110 is located on the second pocket portion 96. Furthermore, a wide variety of retaining mechanisms may be used without departing from the scope of the invention, such as snaps, buttons, clasps, hook-and-loop fasteners, ties, and the like.

The shape and function of the divider pocket of the present invention enables the divider pocket to act as a divider, yet provides a generally flexible pocket for storing loose items. In the embodiment shown in FIGS. 1–4, the access opening 72 is located at an outer edge of the divider pocket 10, which provides ready and easy access for a user. For example, the zipper 76 of the access opening 72 can be accessed without "flipping" to the divider pocket 10; that is, the pouch 65 can be accessed even when located in the middle of a stack of papers. The embodiment of the divider pocket 90 shown in FIGS. 5–7 provides two storage areas for increased capacity, but can fold to a smaller size (i.e. the size of a sheet of paper). The two storage areas also provide the ability to segregate and organize materials in the divider pocket.

Having described the invention in detail and by reference to the preferred embodiments, it will be apparent that modifications and variations thereof are possible without departing from the scope of the invention.

What is claimed is:

1. A divider for use with a binder having a binding mechanism comprising:

a generally rigid inner portion shaped to be coupled to said binding mechanism, said inner portion having an inner edge and an outer edge, and a width extending between said inner edge and said outer edge; and a pocket outer portion, said outer portion having an inner edge and an outer edge, said inner edge being coupled to said outer edge of said inner portion, said outer portion including an upper panel and a lower panel joined together to form an inner cavity therebetween for storing loose items, an access opening which provides access to said inner cavity, and a closing mechanism for selectively closing said access opening, said closing mechanism being located on an end gusset that extends between said upper and lower panels and is oriented generally perpendicular to said upper and lower panels, said outer portion having a width extending between said inner edge and said outer edge of said outer portion, the width of said inner portion being at least approximately equal to the width of the outer portion.

2. The divider of claim 1 wherein said outer portion includes an outer edge, and wherein said access opening is located adjacent said outer edge.

3. The divider of claim 1 wherein said outer portion is flexible.

4. The divider of claim 1 wherein said inner portion includes an outer edge extending generally parallel to said binding mechanism when said inner portion is attached to said binding mechanism, and wherein said outer portion is coupled to said outer edge.

5. The divider of claim 1 wherein said inner portion and said outer portion have about the same width.

6. The divider of claim 1 wherein said inner portion includes at least two openings formed along an inner edge to receive said binding mechanism therethrough.

7. The divider of claim 6 wherein said inner portion includes an inner edge, and wherein said inner portion include at least two slits, each slit extending from said inner edge to one of said at least two openings.

8. The divider of claim 1 wherein said binder is shaped to receive loose leaf papers therein, and wherein said divider has approximately the same size in top view as said loose leaf papers.

9. The divider of claim 1 wherein said inner portion is made of translucent materials.

10. The divider of claim 1 wherein said outer portion is made of transparent materials.

11. The divider of claim 1 wherein said outer portion includes a first pocket portion including said inner cavity and a second pocket portion including an auxiliary inner cavity, said first pocket portion being coupled to said inner portion and said second pocket portion being coupled to said first pocket portion.

12. The divider of claim 11 wherein said second pocket portion is foldable over said first pocket portion.

13. The divider of claim 12 further comprising a retaining mechanism for maintaining said second pocket portion folded over said first pocket portion.

14. The divider of claim 13 wherein said retaining mechanism includes a loop of material on one of said second pocket portion or said inner portion, and a grommet on the other of said second pocket portion or said inner portion, wherein said loop of material is located to fit about said grommet to retain said second pocket portion folded over said first pocket portion.

15. The divider of claim 12 wherein said binder is shaped to receive loose leaf papers therein, and wherein said divider has approximately the same size in top view as said loose leaf papers when said second pocket portion is folded over said first pocket portion.

16. The divider of claim 11 wherein said first pocket portion includes a closable access opening for providing access to said inner cavity and said second pocket portion includes a closable access opening for providing access to said auxiliary inner cavity.

17. The divider of claim 1 wherein said inner portion includes a retaining pocket located thereon.

18. The divider of claim 17 wherein said retaining pocket is shaped to receive a stack of papers therein.

19. The divider of claim 18 wherein said retaining pocket includes a central slit to enable said pocket to act as a dispenser of accordian-style stacked papers.

20. The divider of claim 1 wherein said outer portion is coplanar with said inner portion.

21. The divider of claim 1 wherein said pocket outer portion includes an expandable pocket.

22. The divider of claim 21 wherein said pocket outer portion includes a pair of side gussets to enable said pocket to expand.

23. A divider for use with a binder having a binding mechanism comprising:

a generally rigid inner portion shaped to be coupled to said binding mechanism;

a pocket outer portion, said outer portion having an inner edge coupled to said inner portion, said outer portion including an upper panel and a lower panel facing each other and defining a cavity therebetween, each of said upper panel and lower panels including an outer edge; and a fastener which extends generally along at least part of said outer edges of said upper and lower panels to selectively fasten said upper and lower panels together, said fastener being located on an end gusset that extends between said upper and lower panels and that is generally perpendicular to said upper and lower panels.

24. The divider of claim 23 wherein said fastener selectively opens and closes an access opening, said access opening being located between said outer edges of said upper and lower panels when said upper and lower panels are not fastened along said outer edges.

25. The divider of claim 24 wherein said outer edges are the distal edges of said upper and lower panels relative to said inner portion.

26. The divider of claim 23 wherein said pocket outer portion includes an expandable pocket.

27. The divider of claim 26 wherein said pocket outer portion includes a pair of side gussets to enable said pocket to expand.

28. A divider for use with a binder having a binding mechanism comprising:

a generally rigid inner portion having an inner edge and an outer edge and being shaped to be coupled to said binding mechanism along said inner edge, said inner portion having a height extending along a direction of said inner edge; and a pocket outer portion, said outer portion being coupled to said outer edge of said inner portion and having a height approximately equal to said height of said inner portion, said outer portion including a first pocket portion having an inner cavity and a second pocket portion having an inner cavity for storing loose items therein, said inner cavities of at least one of said first and second pocket portions having a height approximately equal to said height of said inner portion and being located adjacent to each other, said second pocket portion being foldable over said first pocket portion.

29. The divider of claim 28 wherein said first and second pocket portions each include an access opening that extends generally parallel to said height of said outer portion.

30. The divider of claim 29 wherein said first and second pocket portions each include a fastener for selectively opening or closing a respective one of said access openings.

31. The divider of claim 30 wherein said fastener of said second pocket portion is located adjacent an outer edge of said pocket outer portion.

32. The divider of claim 28 further comprising means located on said inner portion and said outer portion for retaining said second pocket portion folded over said first pocket portion.

33. The divider of claim 28 wherein the inner cavities of said first and second pocket portions are spaced apart.

34. The divider of claim 28 wherein said inner cavities of both of said first and second pocket portions have a height approximately equal to said height of said inner portion.

* * * * *